US007235201B2

(12) United States Patent
Hicklen et al.

(10) Patent No.: US 7,235,201 B2
(45) Date of Patent: Jun. 26, 2007

(54) SPLIT DIE AND METHOD FOR PRODUCTION OF COMPACTED POWDER METAL PARTS

(75) Inventors: Edwin Scott Hicklen, Dryden, NY (US); Sean Kuplen, Ithaca, NY (US); Kai Xu, Ithaca, NY (US); Ryan Sun, Ithaca, NY (US)

(73) Assignee: BorgWarner Inc., Auburn Hills, MI (US)

( * ) Notice: Subject to any disclaimer, the term of this patent is extended or adjusted under 35 U.S.C. 154(b) by 228 days.

(21) Appl. No.: 11/017,013

(22) Filed: Dec. 20, 2004

(65) Prior Publication Data

US 2006/0131775 A1 Jun. 22, 2006

(51) Int. Cl.
*B29C 43/04* (2006.01)

(52) U.S. Cl. ..... 264/109; 425/352; 419/66

(58) Field of Classification Search ..... None
See application file for complete search history.

(56) References Cited

U.S. PATENT DOCUMENTS

| | | | | |
|---|---|---|---|---|
| 3,020,589 | A | 2/1962 | Maritano | 18/16.5 |
| 3,773,446 | A | 11/1973 | Borrini | 425/78 |
| 3,891,367 | A | 6/1975 | Signora | 425/78 |
| 4,008,021 | A | 2/1977 | Fedrigo et al. | 425/3 |
| 4,047,864 | A | 9/1977 | DeSantis | 425/78 |
| 5,326,242 | A | 7/1994 | Katagiri et al. | 425/78 |
| 5,378,416 | A | 1/1995 | Kishi et al. | 264/40.5 |
| 5,401,153 | A | 3/1995 | Katagiri et al. | 425/78 |
| 5,478,225 | A | 12/1995 | Takeuchi et al. | 425/78 |
| 5,498,147 | A | 3/1996 | Katagiri et al. | 425/78 |
| 5,698,149 | A | 12/1997 | Hinzmann et al. | 264/120 |
| 6,099,772 | A | 8/2000 | Hinzmann et al. | 264/109 |
| 6,120,728 | A | 9/2000 | Hinzmann et al. | 419/66 |
| 6,165,400 | A * | 12/2000 | Hinzmann | 264/120 |
| 6,318,986 | B1 | 11/2001 | Hinzmann et al. | 425/78 |
| 6,423,264 | B1 * | 7/2002 | Gay | 264/611 |
| 6,789,320 | B2 * | 9/2004 | Mori et al. | 29/898.02 |
| 2002/0192484 | A1 * | 12/2002 | Kohara et al. | 428/546 |

* cited by examiner

*Primary Examiner*—Mary Lynn Theisen
(74) *Attorney, Agent, or Firm*—Brown & Michaels, PC; Greg Dziegielewski

(57) ABSTRACT

A device to compact parts out of powder material including a top die and a bottom die movable with respect to each other from an open position to a closed position, at least one punch associated with each of said dies for relative movement between the die and associated punch, said bottom die and bottom punch movable to positions defining a cavity substantially within said top die for receiving powder therein, said bottom punch and said top and bottom dies being relatively movable to draw powder down into a portion of said cavity adjacent the bottom die that is formed due to said relative movement, said top and bottom punches being movable toward each other to compact the powder and form the part, said top and bottom dies being separable to eject the part. Relative movement of the top and bottom die and bottom punch may take place during filling of the cavity with powder. Alternatively, relative movement may take place after the completion of filling the cavity adjacent the top die with sufficient powder to fill the part.

20 Claims, 5 Drawing Sheets

SPLIT DIE AND METHOD FOR PRODUCTION OF COMPACTED POWDER METAL PARTS

BACKGROUND OF THE INVENTION

The present invention relates to a split die tool set comprising top and bottom dies for the production of compacted parts out of powdered material, and to initially positioning a lower punch to define a chamber for receiving powder. Preferably the lower punch is initially positioned substantially flush with an upper surface of the bottom die. During filling the lower punch may be moved downward and/or the top and bottom dies may be raised to fill chambers adjacent each of the dies with powder. Alternatively, powder may be transferred after completion of the filling step by subsequently moving the lower punch downward and/or raising the top and bottom dies to transfer powder from a chamber adjacent the top die to a chamber adjacent the bottom die.

Devices to compact powder material for the production of sprockets and gears are known in the art. Tool sets with split dies are typically used to form such parts, particularly where the part has two or more rows of teeth that are offset or out of phase with respect to each other. Split die tool sets generally comprise a pair of opposed die and punch sets, each having at least one punch and a die defining respective chambers in each set. At least one of the dies is movable with respect to the other die from an open position in which the sets are separated to a closed position in which the dies are abutted with the respective die chambers in closed communication to form a closed mold cavity. Relative movement of the die and punches in each set is accomplished through movement of either the die or punches, or both, with respect to each other.

The method of forming the part using split die tool sets typically includes filling one or both die chambers with powder material, transfer of powder from one portion of the chambers to another to fill an offset in the part, compaction of the powder, and ejection of the part. One known method of filling the die chambers involves bringing the top and bottom dies to a closed position with the bottom punch defining a bottom die chamber, the top die chamber being in communication with the bottom die chamber, and the top punch being separated from the top die. A movable duct or feeder is brought into position between the top punch and the top die to drop powder into the top and bottom die chambers. A method of this type is disclosed in U.S. Pat. Nos. 3,773,446 and 3,891,367. The '446 patent discloses a complicated press mechanism to prevent bending of the top die when the bottom punch moves upward to compact powder to form the part. A plate presses against the top die during the compaction step to prevent bending that could otherwise occur due to the upwardly directed force of the bottom punch against an offset portion of the part not being counterbalanced by the downward force of a top punch in the top die. The reference discloses filling, compaction and ejection steps, but does not discuss transfer of powder from a chamber in one of the dies to a chamber in the other die even though an offset is present in the part. The '367 patent discloses forming a helical gear with a tool set that comprises a bottom die, bottom punch and core rod, and a top die and top punch. For the filling step, the top die is brought into closed position with the bottom die, the bottom punch forms the bottom of a chamber in the bottom die, and the core rod is raised so that its upper surface is level with the upper surface of the top die. The top punch is raised to its uppermost position and separated from the top die. After the filling step, the top punch is adapted to move downwardly to enter the top die so as to compress the powder in a compacting step. A guide is provided to cause the top punch to mate correctly with the top die as the top punch moves downward. This reference also does not discuss transfer of powder from one chamber to another even though an offset is present in the part.

Another method of filling the die chambers involves separating both the top die and top punch from the bottom die with the bottom punch in a position defining a bottom die chamber. A movable duct is brought into position over the bottom die to drop powder into the bottom die chamber. A method of this latter type is disclosed in U.S. Pat. Nos. 5,698,149, 6,099,772, and 6,318,986. These references disclose various ways of transferring powder from the bottom die chamber to the top die chamber so as to provide sufficient powder in offset portions to completely fill the chambers prior to a compacting step in which the part is formed. The '149 patent discloses moving the top die and top punch downwardly so that the top die engages the bottom die, and then relatively moving the bottom die and bottom punch with respect to each other to transfer powder from the bottom die chamber to the top die chamber. After the transfer step, one of the die and punch pairs is translated with respect to the other pair, either rotationally or laterally, so as to provide a phased offset in the part. The '772 patent discloses a tool set comprising a bottom die and two nested bottom punches movable with respect to each other and the bottom die. A chamber is formed in the bottom die and punch set by moving the bottom punches to their lowest positions. After filling, the top die and punch are moved downward to form a chamber having an offset with respect to the chamber in the bottom die. Transfer of powder from the chamber in the bottom die to the chamber in the top die is accomplished by moving the lowermost bottom punch upwardly to a position where its upper surface is level with the upper surface of the other bottom punch.

The '986 patent is a continuation-in-part of the '772 patent and discloses another tool set as shown in FIG. 5 thereof. The tool set comprises top and bottom dies, each having two nested punches movable with respect to each other. The top punches are separable from the top die so that the top die may be brought into contact with the bottom die. The top die has a chamber that forms an offset with respect to the chamber in the bottom die. The bottom punches are then positioned so as to form a chamber bounded by the bottom die. After filling the two die chambers, the dies are moved upwardly with respect to the bottom punches causing powder to flow between the dies. Due to a shoulder formed by an offset in the dies, powder may be carried upwardly with the bottom die to create a local high spot or hump above the shoulder. The top punches are then inserted into the top die with the innermost top punch raised relative to the outer top punch until the outer punch is correctly spaced from the shoulder. To ensure that the bridging of powder at undercut u (FIGS. 5*a* and 5*b*) is eliminated the innermost top and bottom punches are lowered relative to the outer bottom punch. At the same time the top and bottom dies move downwardly relative to the outer bottom punch until the punches and dies assume correct relative positions for initial compaction. This toolset requires additional steps to transfer powder between the die chambers.

SUMMARY OF THE INVENTION

In one aspect the invention comprises a tool set to compact a part out of powder material, including (a) a top die movable along an axis relative to a bottom die; (b) at least one top punch associated with said top die for relative movement within said top die; (c) at least one bottom punch associated with said bottom die for relative movement within said bottom die; (d) said top die being engageable with said bottom die to define a closed position when said dies are abutted; (e) said top and bottom dies being initially positionable in contact with a lower punch engaged in the lower die and substantially flush with an upper surface of the lower die to create a cavity for receiving powder when said dies are in closed position and said top punch is raised and separated from said top die; (e) said top and bottom dies and said bottom punch being relatively movable to permit powder to flow downwardly from a chamber adjacent the top die to a chamber adjacent the bottom die; (f) said top and bottom punches being movable toward each other with said dies in the closed position to compact powder material to produce the part; (g) said top and bottom dies movable to an open separated position for ejection of the compacted part. The top and bottom dies and said bottom punch may be relatively movable during filling with the top punch raised or after filling with or without the top punch engaged in the top die. The tool set may include a core rod that is slidably movable within the bottom punch to a position defining a portion of a chamber in the top die for receiving powder during filling and to a raised position within the top die.

Unlike many prior art methods for the production of powder metal parts using split die tool sets, the invention, in one or more embodiments, does not have a powder transfer step. In one embodiment, the invention includes a method wherein prior to filling with powder, initially positioning top and bottom dies in contact with a lower punch engaged in the lower die preferably at a level substantially flush with an upper surface of the lower die to create a cavity for powder. The cavity is filled with powder by moving a feeder box across the top of the upper die and allowing powder to fall into the cavity formed by the upper die, lower die and the lower punch. The lower punch may be moved downward during the filling step in order to draw powder into the cavity by suction. Preferably, both dies remain stationary during the filling step. Instead of a powder transfer step, the downward movement of the lower punch during filling causes the powder to move from the cavity adjacent the upper dies to a cavity adjacent the lower dies that is formed as the lower punch moves downward. Alternatively, the lower punch may remain stationary while the dies are moved upwardly during filling. A core rod may be moved up into the top punch during the filling step. The punches are then actuated in order to compress the powder. Following compression, the dies are separated and the finished part is removed.

In another embodiment, the invention includes a toolset in which prior to filling with powder, top and bottom dies are initially positioned in contact with a lower punch engaged in the lower die to create a cavity for the receipt of powder. Preferably the lower punch is positioned so that its upper surface is at a level substantially flush with an upper surface of the lower die, to create a cavity for powder adjacent the upper die. A core rod is initially positioned so as to have an upper surface substantially level with an upper surface of the lower punch prior to the filling step. Alternatively, the core rod may be initially positioned so that its upper surface is substantially level with an upper surface of the top die. The core rod may be raised further after filling so as to engage an opening in the top punch. The cavity is filled with powder by moving a feeder box across the top of the upper die and allowing powder to fall into the cavity formed by the upper die, lower die and the lower punch. After filling the cavity with sufficient powder to form the part, the lower punch preferably is moved downward in order to draw powder into the cavity by suction. Preferably, the top punch is engaged with the upper die and both dies remain stationary during this step. Alternatively, the lower punch may remain stationary while the dies are moved upwardly. The top and bottom punches are then actuated in order to compress the powder. Following compression, the dies are separated and the finished part is removed

DETAILED DESCRIPTION OF THE PREFERRED EMBODIMENTS

Figure 1:
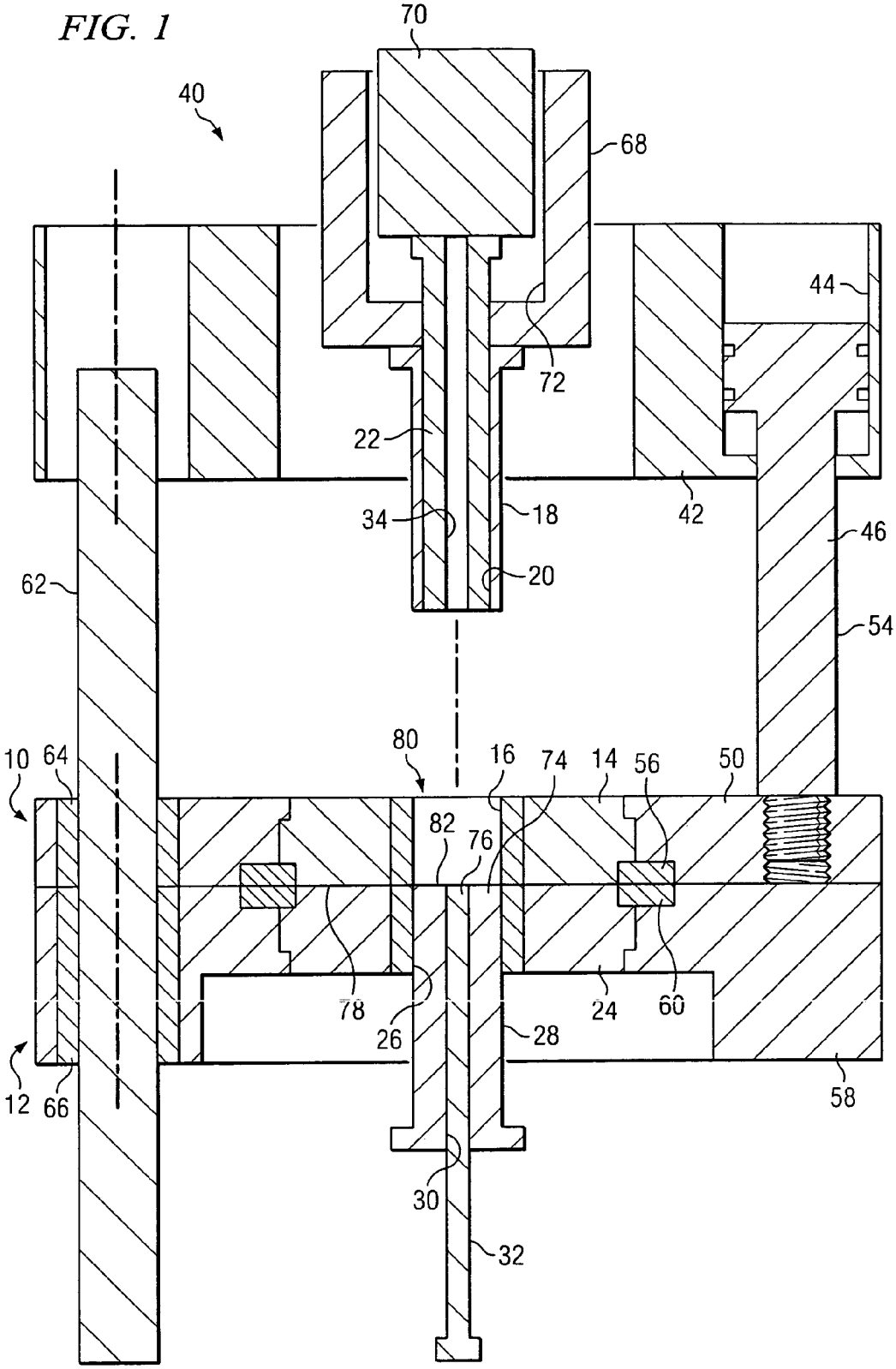
FIG. 1 is a vertical section of a portion of a press with a tool set according to the present invention shown in the initial position creating a cavity for powder.

Referring to FIGS. 1–5, the invention includes a tool set that has a top die and punch set 10, and bottom die and punch set 12. Top set 10 includes die 14 having an opening 16 for receiving outer punch 18 slidably therein. Outer punch 18 has an opening 20 for receiving inner punch 22 slidably in said opening. Bottom set 12 includes die 24 having opening 26 for receiving punch 28 slidably therein. Punch 28 has an opening 30 for receiving core rod 32 slidably in the opening. Inner punch 22 has an opening 34 for receiving core rod 32 slidably therein.

The tool set is shown mounted in a press 40 that has a hydraulic platen 42 with a bore 44 in which hydraulic piston 46 is received slidably therein. The hydraulic piston is attached to upper die plate 50 at the threaded end 52 of piston rod 54. Top die 14 is mounted in upper die plate 50 and secured therein by clamp 56. Bottom die 24 is mounted in lower die plate 58 and secured therein by clamp 60. Die plates 50 and 58 are slidably movable on stationary press rod 62 through sleeves 64 and 66, each mounted in an opening in the respective die plates. Thus, top die 14 and bottom die 24 are movable upwardly and downwardly through the action of hydraulic piston 46 in platen 42. The press utilized with the tool set of this invention may be mechanically driven, hydraulically actuated or a combination of these two means of actuation.

Outer punch 18 is mounted in outer punch adapter 68 that has an opening for receiving inner punch 22 slidably therein. Inner punch 22 is mounted in inner punch adapter 70, which is slidably received in opening 72 of outer punch adapter 68. The press includes apparatus (not shown) for slidably moving outer punch 18 and inner punch 22 relative to each other. Similarly, the press includes apparatus (not illustrated) for slidably moving bottom punch 28 and core rod 32 relative to each other in a manner described below.

Figure 2:
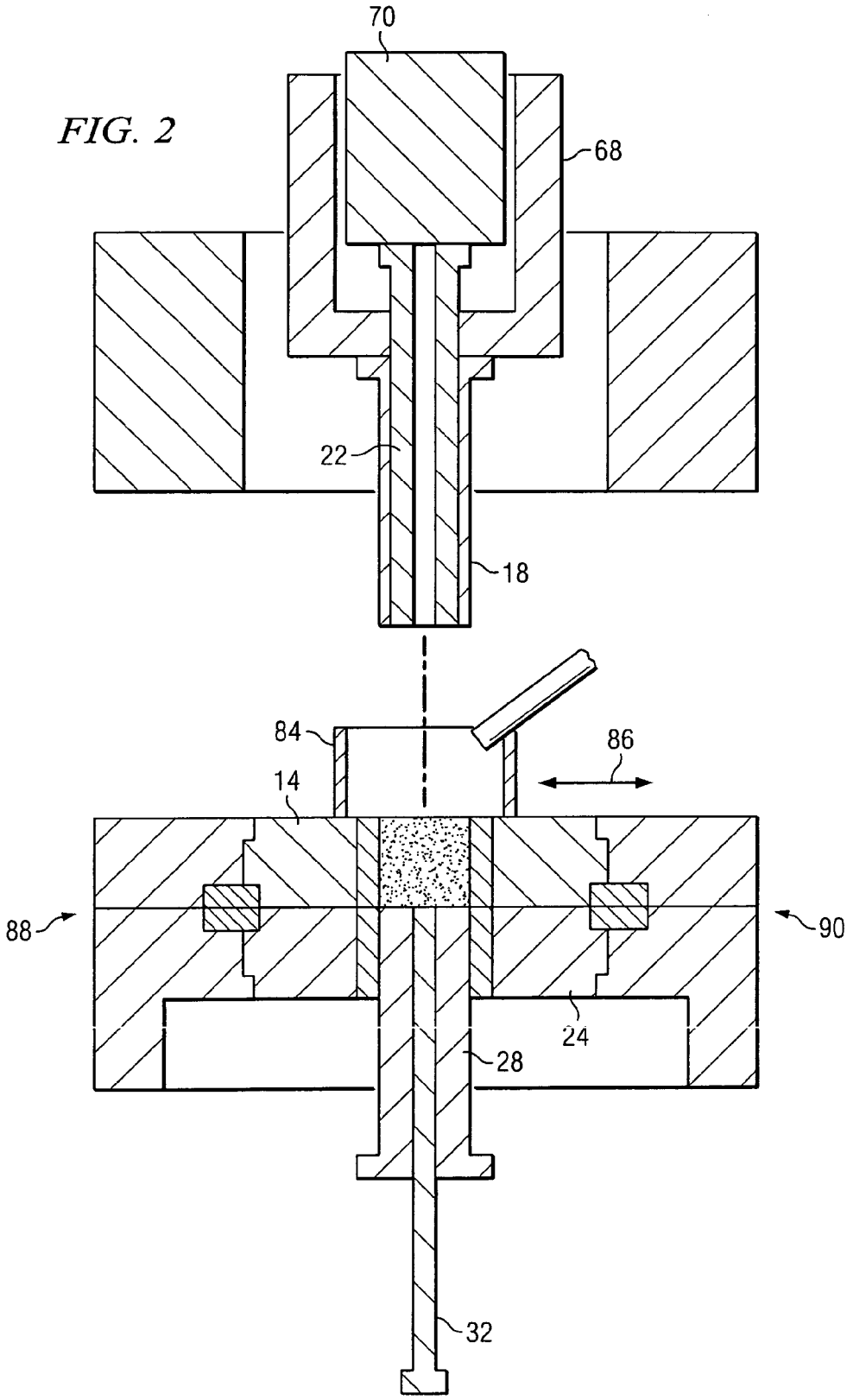
FIG. 2 shows the tool set of FIG. 1 with a feeder in position above the top die.

Referring to FIG. 1 the tool set is shown in initial position defining cavity 80 for filling top die 14 with powder. Bottom punch 28 and core rod 32 have their upper end faces 74 and 76 are shown substantially at a level flush with upper surface 78 of bottom die 24 so as to form cavity 80. Bottom punch 28 may be at a slightly lower level, for example, if prohibited from being flush with surface 78 due to channels (not shown) in bottom die 24 for delivering powder from top die 14. Cavity 80 has side surfaces bounded by opposed side walls of top die 14, and a bottom surface 82 bounded by upper end face 74 of punch 28 and upper end face 76 of core rod 32. Outer top punch 18 and inner top punch 22 are raised and separated from top die 14. At least a majority of the cavity in FIG. 2 shows the tool set in the initial position with feeder shoe 84 located over top die 14. Feeder shoe 84 is movable back and forth in a direction indicated by arrows 86 from the front 88 of the press to the back 90 thereof.

Figure 3:
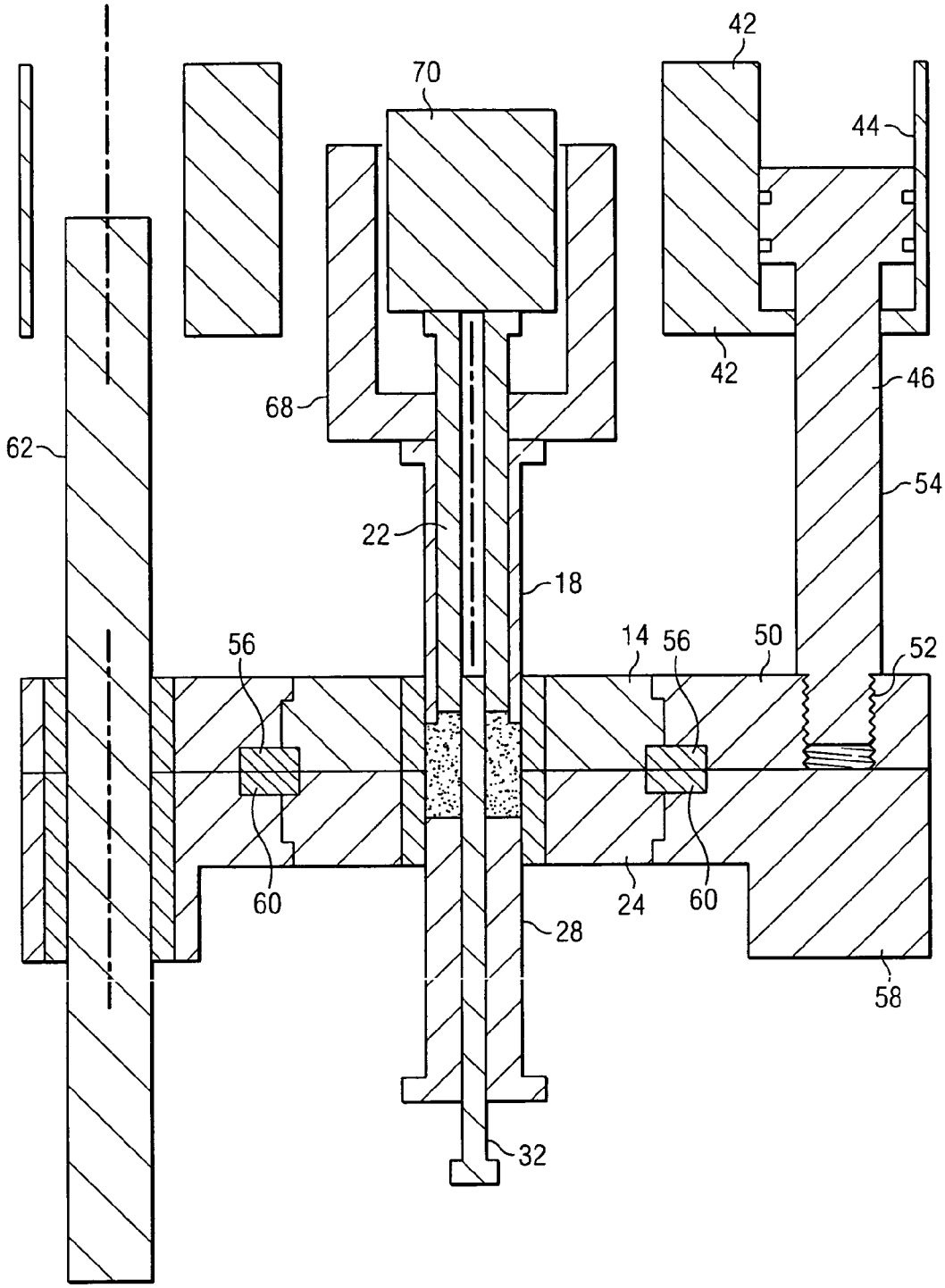
FIG. 3 shows the press with the tool set of FIG. 1 after drawing powder downwardly into the cavity.

FIG. 3 shows the tool set positioned after drawing powder downwardly in the cavity adjacent to bottom die 24. In one embodiment powder is drawn downwardly during the filling step with outer and inner top punches 18 and 22 raised above top die 14. This may be accomplished by moving bottom punch 28 downwardly during filling. Preferably top die 14 and bottom die 24 remain stationary while bottom punch 28 moves down. Alternatively, top die 14 and bottom die 24 may be moved upwardly to draw powder downwardly during filling. Core rod 32 is shown in a raised position extending into opening 34 of inner top punch 28 after having been moved upwardly, either directly or by lowering the dies and punches with respect to the core rod.

In another embodiment sufficient powder is received in cavity 80 shown in FIG. 1 to form the part. Subsequent to the completion of filling, powder is drawn downwardly into a lower portion of cavity 80 formed adjacent bottom die 24 as shown in FIG. 3 during a separate transfer step. Such transfer may be accomplished by moving bottom punch 28 downwardly, preferably while the top die 14 and bottom die 24 remain stationary or, alternatively by moving the top and bottom dies upwardly with respect to bottom punch 28. Preferably after filling but before transfer outer top punch 18 and inner top punch 22 are brought to a lowered position to the top of the powder so as to close the cavity formed in the top and bottom dies. Transfer may be accomplished with the top punches engaged with the powder in top die 14 to close the mold cavity. Another method of transfer is to further move outer and inner top punches 18 and 22 downwardly together with bottom punch 28. Where the top die and bottom die have geometries that are either opposing, differ in profile, or—in the case of sprockets or gears—differ in the number or phasing of teeth, powder moves downwardly in what are called transfer channels. Where the top die teeth are out of phase with respect to bottom die teeth, powder is transferred via channels that direct powder flow from the teeth of the top die into the teeth of the bottom die. Where such channels are present the bottom punch may only reach an initial position substantially flush with the upper surface of the bottom die.

Figure 4:
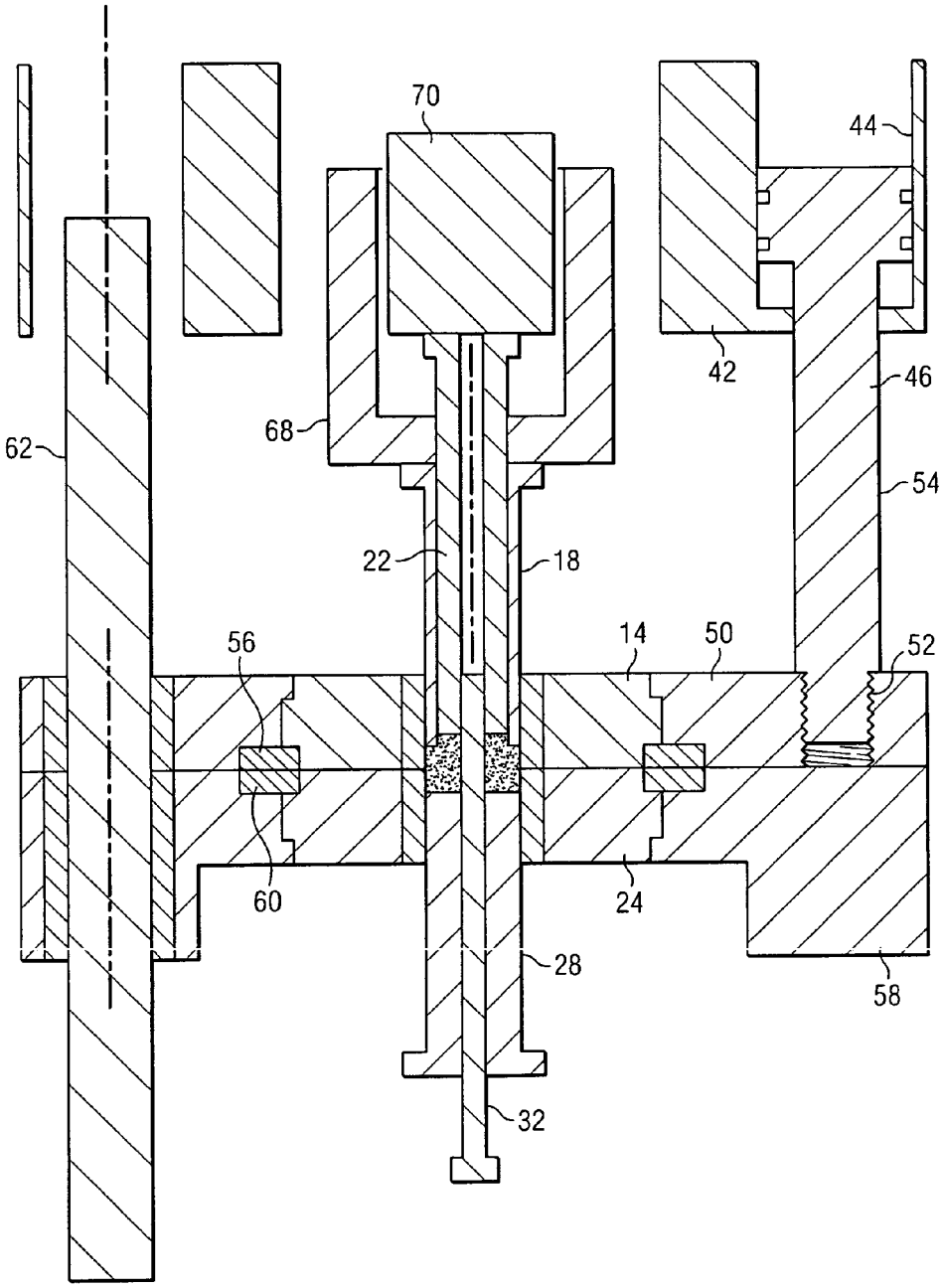
FIG. 4 shows the press with the tool set of FIG. 1 in the compaction position.
Figure 5:
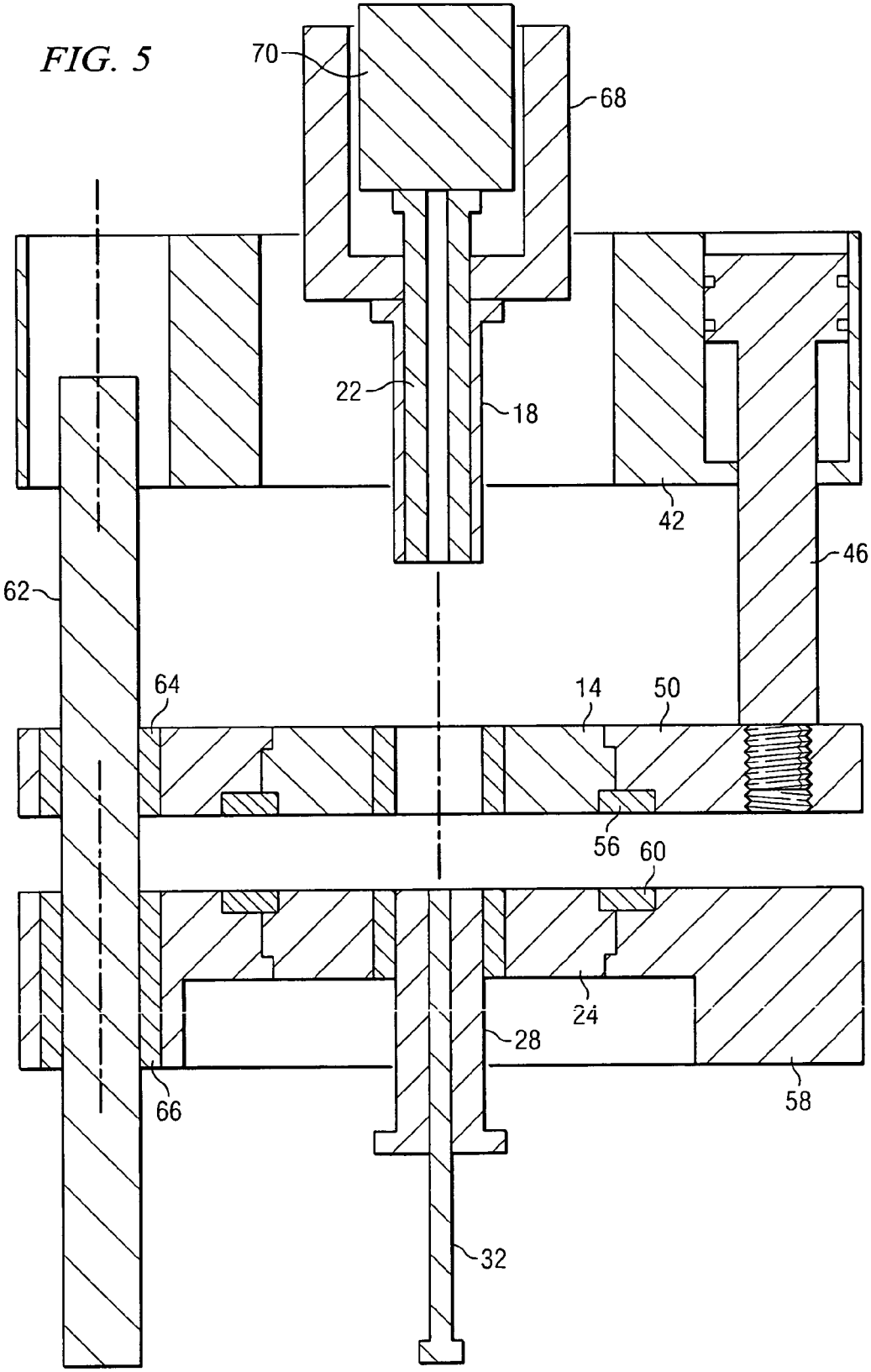
FIG. 5 shows the press with the tool set of FIG. 1 in the ejection position.

After powder is drawn downwardly from the top die to the bottom die either during or after filling, the powder is compacted to form the part as shown in FIG. 4. To accomplish compaction, outer top punch 18 and inner punch 22 are moved downwardly and bottom punch 28 is moved upwardly to compress the powder between the dies and punches. Then, after compaction, the part is ejected as shown in FIG. 5. Ejection is accomplished by moving top die 14 and bottom die 24 away from each other and moving core rod 32 down to a lowered position. Also, bottom punch 28 is moved up or bottom die 24 is moved downwardly with respect to bottom punch 28 to eject the part from the bottom die. And, outer top punch 18 and inner top punch 22 are moved downwardly with respect to top die 14 or top die 14 is moved upwardly with respect to outer top punch 18 and inner top punch 22 to eject the part from top die 14.

While one or more preferred embodiments of the invention have been identified, other configurations and modifications can be provided within the scope of the present invention.

What is claimed is:

1. A method of producing a compacted part out of powder material by utilizing a tool set having a top die, a bottom die, at least one top punch associated with said top die, and at least one bottom punch associated with said bottom die, said method comprising the steps of:

(a) prior to filling with powder, initially positioning the top and bottom dies in contact with a bottom punch engaged in the bottom die to create a cavity for powder substantially adjacent the top die;

(b) filling the cavity by moving a feeder box across the upper surface of the top die and allowing powder to fall into the cavity formed by the top die, bottom die and the bottom punch;

(c) during the filling of said cavity with powder relatively moving the top and bottom die and bottom punch in order to draw powder downwardly into a portion of said cavity that is formed adjacent to said bottom die due to said relative movement;

(d) compacting the powder in said top and bottom die chambers by moving said top and bottom punches toward each other; and (e) after compaction of the powder moving the top and bottom dies away from each to eject the compacted part.

2. The method of claim 1 wherein said step of prior to filling with powder, includes positioning said bottom punch at a level substantially flush with an upper surface of the bottom die to create a cavity for powder substantially adjacent the top die.

3. The method of claim 1 wherein said tool set further comprises a core rod slidably movable in said bottom punch and said step of prior to filling with powder includes positioning said bottom punch and said core rod to create a cavity substantially adjacent the top die for the powder.

4. The method of claim 3 wherein said step of prior to filling with powder includes said bottom punch and core rod being positioned substantially at a level flush with an upper surface of said bottom die.

5. The method of claim 1, wherein said relative movement involves said top and bottom dies moving upward while said bottom punch remains stationary.

6. The method of claim 1, wherein said relative movement involves said top and bottom dies simultaneously moving up while said bottom punch moves down.

7. The method of claim 1, wherein said step of ejecting the part includes said bottom die moving downward relative to said bottom punch.

8. The method of claim 1, wherein said step of ejecting the part includes said bottom punch moving upward relative to said bottom die.

9. The method of claim 1, wherein said step of ejecting the part includes moving the top punch downwardly with respect to the top die.

10. The method of claim 1, wherein said step of ejecting the part includes moving the top die upwardly with respect to the top punch.

11. A method of producing a compacted part out of powder material by utilizing a tool set having a top die, a bottom die, at least one top punch associated with said top die, and at least one bottom punch associated with said bottom die, said method comprising the steps of:

(a) prior to filling with powder, initially positioning the top and bottom dies in contact with a bottom punch engaged in the bottom die to create a cavity for powder substantially adjacent the top die;

(b) filling the cavity with sufficient powder to form the part by moving a feeder box across the upper surface of the top die and allowing powder to fall into the cavity formed by the top die, bottom die and the bottom punch;

(c) after filling said cavity with powder relatively moving the top and bottom die and bottom punch in order to draw powder downwardly into a portion of said cavity that is formed adjacent to said bottom die due to said relative movement;

(d) compacting the powder in said top and bottom die chambers by moving said top and bottom punches toward each other; and (e) after compaction of the powder moving the top and bottom dies away from each to eject the compacted part.

12. The method of claim 11 wherein said step of prior to filling with powder, includes positioning said bottom punch at a level substantially flush with an upper surface of the bottom die to create a cavity for powder substantially adjacent the top die.

13. The method of claim 11 wherein said tool set further comprises a core rod slidably movable in said bottom punch and said step of prior to filling with powder includes positioning said bottom punch and said core rod to create a cavity substantially adjacent the top die for the powder.

14. The method of claim 13 wherein said step of prior to filling with powder includes said bottom punch and core rod being positioned substantially at a level flush with an upper surface of said bottom die.

15. The method of claim 11, wherein said relative movement involves said top and bottom dies moving upward while said bottom punch remains stationary.

16. The method of claim 11, wherein said relative movement involves said top and bottom dies simultaneously moving up while said bottom punch moves down.

17. The method of claim 11, wherein said step of ejecting the part includes said bottom die moving downward relative to said bottom punch.

18. The method of claim 11, wherein said step of ejecting the part includes said bottom punch moving upward relative to said bottom die.

19. The method of claim 11, wherein said step of ejecting the part includes moving the top punch downwardly with respect to the top die.

20. The method of claim 11, wherein said step of ejecting the part includes moving the top die upwardly with respect to the top punch.

* * * * *